US008267006B2

(12) United States Patent
Malm et al.

(10) Patent No.: US 8,267,006 B2
(45) Date of Patent: Sep. 18, 2012

(54) AXIAL PISTON MACHINE

(75) Inventors: Stefan Malm, Melsungen (DE); Renald Kuempel, Herpf (DE)

(73) Assignee: Neumayer Tekfor Holding GmbH, Hausach (DE)

( * ) Notice: Subject to any disclaimer, the term of this patent is extended or adjusted under 35 U.S.C. 154(b) by 0 days.

(21) Appl. No.: 13/022,689

(22) Filed: Feb. 8, 2011

(65) Prior Publication Data

US 2011/0126702 A1 Jun. 2, 2011

Related U.S. Application Data

(63) Continuation of application No. PCT/DE2009/001178, filed on Aug. 21, 2009.

(30) Foreign Application Priority Data

Aug. 22, 2008 (DE) ..... 10 2008 039 294

(51) Int. Cl.
*F16J 1/00* (2006.01)

(52) U.S. Cl. ..... 92/260; 92/71; 29/888.043

(58) Field of Classification Search ..... 92/71, 172, 92/255, 260; 29/888.04, 888.042, 888.043, 29/888.044

See application file for complete search history.

(56) References Cited

U.S. PATENT DOCUMENTS 4,207,779 A * 6/1980 Papst ..... 91/499
2008/0080986 A1 4/2008 Hinrichs

FOREIGN PATENT DOCUMENTS

WO WO 2006/056167 A1 6/2006
WO WO 2008014737 A1 * 2/2008

* cited by examiner

*Primary Examiner* — Michael Leslie
(74) *Attorney, Agent, or Firm* — Crowell & Moring LLP

(57) ABSTRACT

An axial piston intended for an axial piston machine and comprised of at least two components forming a driving part and a compressing part. To enable manufacture of the axial piston in an easy and inexpensive way while simultaneously reducing the weight, the components are manufactured by a solid forming process and joined together by a capacitor discharge welding process.

4 Claims, 1 Drawing Sheet

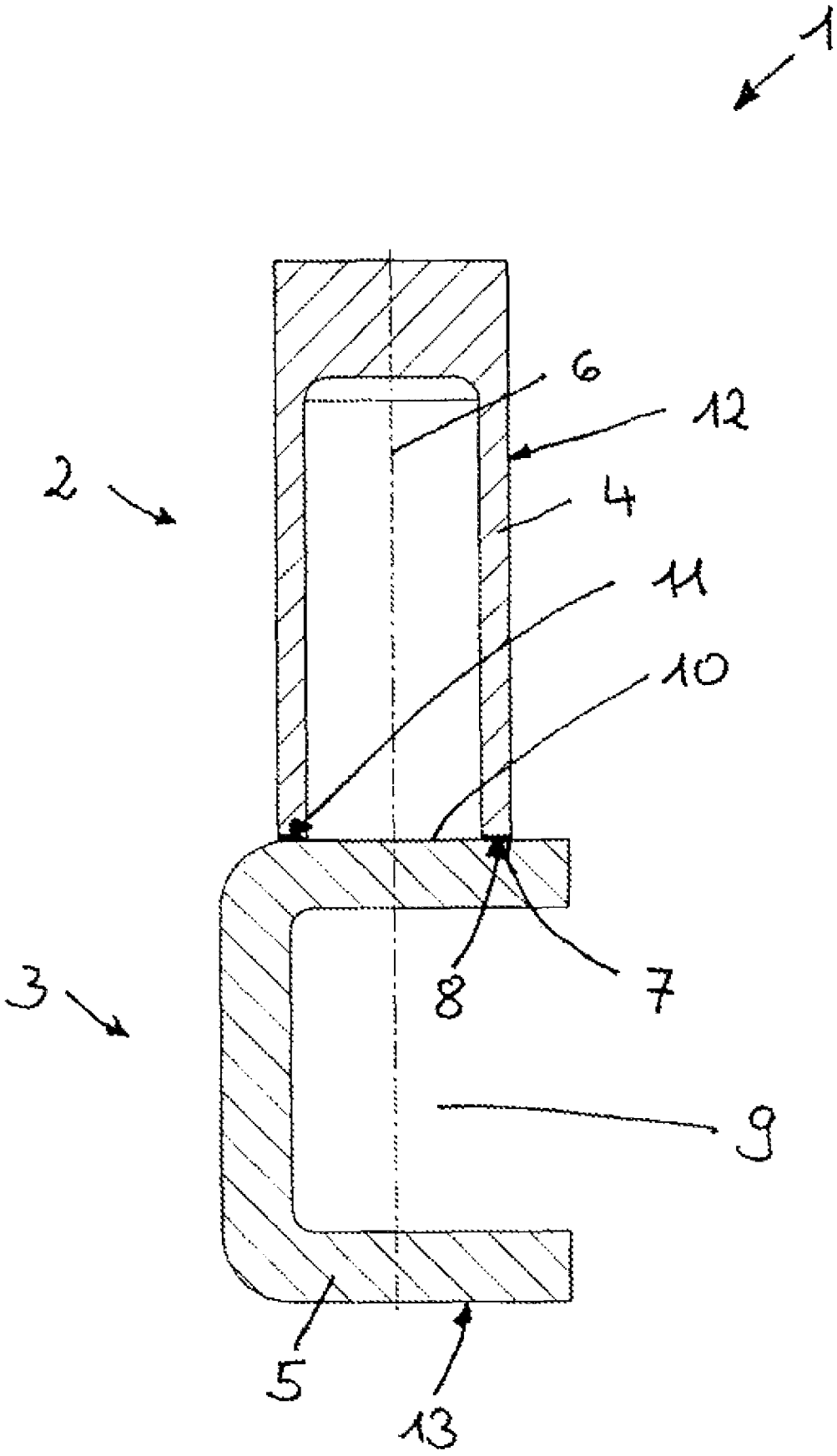
1
2
3
4
5
6
7
8
9
10
11
12
13

AXIAL PISTON MACHINE

CROSS REFERENCE TO RELATED APPLICATIONS

This application is a continuation of international application no. PCT/DE2009/001178, filed Aug. 21, 2009, designating the United States of America and published in German on Feb. 25, 2010 as WO 2010/020240, the entire disclosure of which is incorporated herein by reference. Priority is claimed based on Federal Republic of Germany patent application no. DE 10 2008 039 294.4, filed Aug. 22, 2008.

BACKGROUND OF THE INVENTION

The invention relates to an axial piston for an axial piston machine. Axial piston machines are known, for example, from WO 2006/056167 A1. Such axial piston machines are used as air conditioning compressors especially in motor vehicles and are rotationally driven from an external drive source. In this case a swash ring or the like, which is positioned at an oblique angle to the axis of the rotary drive, engages with a driving part of the axial piston and moves the axial piston back and forth parallel to the axis of rotation during a rotational movement of the rotary drive. At the same time the compressing part, which is part of the axial piston and is guided in a cylinder, compresses the working medium of the axial piston machine.

To this end, axial pistons for the axial piston machines are usually made as cast or sintered parts or as two parts composed of the driving part and the compressing part. For this purpose individual parts are used that are joined together by laser or friction welding techniques. In some cases extensions, which are formed axially on the driving part and which are expensive from a manufacturing viewpoint, are provided to receive the sleeve-shaped compressing part.

Due to the manufacturing process the components are necessarily heavy and in some cases exhibit insufficient mechanical properties. Owing to the kind of parts that are used, it is necessary to apply welding techniques that are time-consuming and consequently cost-intensive. Furthermore, the preparation of the weld edges is labor intensive. High heat inputs caused by the welding techniques that are used can lead to component warping and microstructural transformation with brittleness of the weld spots.

SUMMARY OF THE INVENTION

Therefore, it is an object of the invention to provide an improved axial piston.

Another object of the invention is to provide an axial piston which can be easily manufactured at an inexpensive cost.

These and other objects of the invention have been achieved by providing an axial piston that is intended for an axial piston machine and that consists of at least two components which form a driving part and a compressing part, wherein the components are manufactured by a solid forming process and joined together by a capacitor discharge welding process. The use of a solid forming process makes it possible to manufacture the components as inexpensive mass production goods that enable, as a function of how the components are used, a degree of precision that is adequate for the components without or with subsequent machining. Depending on the type of solid forming process, various kinds of material can be used, for example, steels of various alloys. Methods that have proved to be especially advantageous are cold extrusion techniques in which the components are manufactured inexpensively in the desired shape at ambient temperature in high quantities.

A welding technique that has proved to be especially advantageous is butt welding of the compressing part on the driving part. This means that the front face of the compressing part is joined as the welding area with a complementary welding area of the driving part, so that there is no need for additional axial extensions and overlapping regions on the driving part. Due to the short term heat input during the welding process by the capacitor discharge welding technique, the components do not warp, and the welding area does not become brittle, so that the welding areas and, thus, the walls of the components can be designed merely as a function of the requirements of the axial pistons and not as a function of the conditions for the welding process, so that in total it is easier to construct the axial piston.

Furthermore, it has proved to be advantageous to machine the welding areas of the components to mill them to desired shape. Such a production step is simple, since the welding areas are to be formed essentially flat, and such a step ensures that the components will be welded over their entire joint welding area. As used herein, the term "welding areas that have a flat structure" includes welding areas that have a slightly tapering structure, for example, a roof-shaped welding area for improved guidance of the current flow during the capacitor discharge welding process.

The axial piston may comprise heat-treated, for example, surface-hardened components. In this case nitriding has proved to be advantageous. Such a heat treatment preferably is conducted after the welding process, because, for example, the free end of the totally closed compressing part that is welded to the driving part cannot tolerate any thermal warping or can tolerable only negligible thermal warping.

Furthermore, the invention comprises an axial piston machine comprising one or more axial pistons according to the above-described features.

In accordance with a further aspect of the invention, an axial piston is comprised of at least two components forming a driving part and a compressing part, and is manufactured by a method comprising the following steps:

- producing the components by a material forming method,
- machining the welding areas of the components in preparation for welding,
- positioning a free end of the compressing part in relation to a peripheral region of the driving part,
- joining the components by a capacitor discharge welding process, and
- heat treating the axial piston.

BRIEF DESCRIPTION OF THE DRAWINGS

The invention will be explained in further detail hereinafter with reference to an illustrative embodiment depicted in the accompanying drawing FIGURE, which is a sectional view of an axial piston according to the invention.

DETAILED DESCRIPTION OF PREFERRED EMBODIMENTS

In the illustrated embodiment the axial piston 1 is comprised of two parts composed of the components 2, 3, which form a compressing part 4 and a driving part 5. The compressing part 4 is produced as a cylindrical component 2 in a rotationally symmetrical manner about the axis of rotation 6, preferably by a cold extrusion technique—for example, in a deep drawing process or in a reversed bowl extrusion process.

The free end of the compressing part 4 has a front face 7, which either in the form in which it comes out of the forming tool, or preferably after machining, forms a welding area 8 for joining with the driving part 5.

The driving part 5 receives the tilted swash ring or the swivel arm or the like of the rotary drive of the axial piston machine in a press-formed recess 9 and is configured to conform to the structural design of the rotary drive. Accordingly, the driving part 5 is produced by a solid forming process in which cold, semi-hot or hot forming techniques—for example, extrusion techniques and/or bending techniques—can be used. The driving part 5 receives the compressing part 4 on its essentially flat external circumference 10. In this case the compressing part exhibits an as removed from the forming tool, or preferably a machined, welding area 11, which is complementary to the welding surface 8 of the compressing part 4. In particular, if semi-hot or hot forming techniques are used, the surface of the components 2, 3 can be subsequently treated not only for the purpose of preparing the welding areas 8, 11 but also for the purpose of achieving a higher surface quality.

The joining of the two welding areas 8, 11 is carried out by a capacitor discharge welding process. Owing to the small amount of heat input of this method, the thermal warpage can be kept low, and an adequate strength of the joint between the driving part 5 and the compressing part 4 can be achieved even if the compressing part 4 has thin walls. It is self-evident that the depiction of the wall thickness and other geometric measures that can be inferred from the FIGURE is not to be construed necessarily as true to scale.

The surfaces 12, 13 of one or both components 2, 3, or the complete components 2, 3 themselves, can be subjected partially or totally to a heat treatment. This heat treatment can result in a surface hardening and can be carried out under suitable environmental conditions. For example, the components 2, 3 can be nitrided or carbonitrided. It has proved to be especially advantageous if such a heat treatment takes place after the joining of the two components 2, 3, so that the heat effect on the free end of the compressing part 4 that is already mounted on the driving part 5 exerts a reduced influence, and, thus, thermal warpage can be essentially ruled out.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A method for producing an axial piston comprising at least two components, forming a driving part and a compressing part, said method comprising:

producing the two components by a solid forming method which is a cold extrusion process, machining welding areas of at least one of the components, positioning a free end of the compressing part in relation to an outer periphery of the driving part, joining the components by a capacitor discharge welding process at the machined welding areas, heat treating the axial piston.

2. The method according to claim 1, wherein the compressing part is butt welded on the driving part.

3. The method according to claim 1, wherein the two components are nitrated.

4. The method according to claim 1, wherein the two components are heat treated after the welding process.

* * * * *